US007137870B1

(12) United States Patent
Kim

(10) Patent No.: US 7,137,870 B1
(45) Date of Patent: Nov. 21, 2006

(54) APPARATUS ADAPTED TO SENSE BROKEN PLATEN BELT

(75) Inventor: Mu-Yeoun Kim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/387,856

(22) Filed: Mar. 24, 2006

(30) Foreign Application Priority Data

Nov. 3, 2005 (KR) ..... 10-2005-0104767

(51) Int. Cl.
*B24B 49/00* (2006.01)

(52) U.S. Cl. ..... 451/6; 451/5; 451/8

(58) Field of Classification Search ..... 451/6, 451/8, 41, 28, 5, 296, 297, 285–289
See application file for complete search history.

(56) References Cited

U.S. PATENT DOCUMENTS 5,816,970 A * 10/1998 Chae ..... 474/101
6,413,873 B1 7/2002 Li et al.
6,532,810 B1 3/2003 Ahmed
6,887,129 B1 * 5/2005 Birang et al. ..... 451/10
2003/0128127 A1 7/2003 Jan

* cited by examiner

*Primary Examiner*—Dung Van Nguyen
(74) *Attorney, Agent, or Firm*—Volentine Francos & Whitt, PLLC

(57) ABSTRACT

Embodiments of a wafer polishing and broken platen belt sensing apparatus are disclosed, wherein the apparatus comprises a polishing platen, a motor, a platen belt, a photo sensor, and an encoder connected to the motor and adapted to output a first signal in accordance with the rotational speed of the motor. In one embodiment, the apparatus comprises a photo sensor adapted to output a second signal in accordance with the rotational speed of the polishing platen and is adapted to generate an interlock signal when the motor and the polishing platen are not both rotating normally. In another embodiment, the apparatus comprises a photo sensor adapted to output the second signal in accordance with the rotational speed of the platen belt and is adapted to generate an interlock signal when the motor and the platen belt are not both rotating normally.

18 Claims, 7 Drawing Sheets

APPARATUS ADAPTED TO SENSE BROKEN PLATEN BELT

BACKGROUND OF THE INVENTION

1. Technical Field

Embodiments of the invention relate to a wafer polishing apparatus. More particularly, embodiments of the invention relate to a wafer polishing and broken platen belt sensing apparatus adapted to sense when a platen belt has broken.

This application claims priority to Korean Patent Application No. 10-2005-0104767, filed Nov. 3, 2005, the subject matter of which is hereby incorporated by reference in its entirety.

2. Discussion of Related Art

In order to form contemporary semiconductor devices, which are smaller and more densely integrated than ever, very flat wafers are required. A number of flattening methods, such as the spin on glass (SOG) method, the etch back method, the reflow method, etc., have been developed. Each of these methods is designed to flatten and smooth the working surface of a wafer.

During a typical wafer flattening process, mechanical polishing and chemical polishing are combined to produce better results than might be achieved by the use of either polishing type alone, since mechanical polishing alone is generally unable to produce sufficiently flat wafer surfaces and chemical polishing is too slow. Thus, various chemical mechanical polishing (CMP) techniques are used which flatten the surface of a wafer using a combination of the mechanical and chemical polishing effects.

In a typical CMP process, a rotating polishing pad fixed to a polishing table is used in combination with a rotating polishing head to apply regular pressure on a wafer fixed to the polishing head by surface tension or vacuum pressure. That is, the weight and applied pressure of the polishing head force the polishing pad and the working surface of the wafer into contact. A slurry is usually applied to this mechanical process through a very narrow gap between the surface of the wafer and the polishing pad. The mechanical polishing effects of the polishing pad may be enhanced through the introduction of abrasive polishing particles in the slurry, and chemical polishing effects may be introduced through an appropriate selection of chemical ingredients in the slurry.

Obtaining uniform and well controlled rotation of the polishing platen holding the polishing pad is an important aspect of the foregoing CMP process. U.S. Patent Application No. 2003-0128127 A1 discloses one exemplary system adapted to monitor the tension of a robot-controlled platen belt used to rotationally drive a polishing platen. In this conventional system, a belt tension monitor is used. An upper tension limit and a lower tension limit for the platen belt are monitored using the belt tension monitor. This type of monitoring is designed to prevent the platen belt from becoming damaged during operation, and to generally extend the platen belt's useful life.

Although the conventional system monitors upper and lower tension limits, it is not adapted to detect a complete failure of the platen belt. As a result, a platen belt failure (e.g., a break) often causes severe damage to a wafer being processed.

SUMMARY OF THE INVENTION

Embodiments of the invention provide a wafer polishing and broken platen belt sensing apparatus adapted to sense the failure of a platen belt, and stop the wafer polishing process upon sensing such a failure. By so doing, embodiments of the invention prevent loss of a wafer due to a platen belt failure.

In one embodiment, the invention provides a wafer polishing and broken platen belt sensing apparatus comprising; a polishing platen adapted to rotate a polishing pad, a motor adapted to rotate the polishing platen, a first drive pulley disposed around a driving axis of the motor, a second drive pulley disposed below the polishing platen and around a rotational axis of the polishing platen, a platen belt connecting the first drive pulley and the second drive pulley, an encoder connected to the motor and adapted to output a first square wave signal in accordance with rotational speed of the motor, a current generating unit adapted to generate a motor driving current in accordance with the first square wave signal, a photo sensor adapted to output a second square wave signal in accordance with the rotational speed of the polishing platen, and a controller adapted to receive the motor driving current and the second square wave signal, to determine whether the polishing platen and the motor are rotating normally, and to generate an interlock signal when the polishing platen is not rotating normally.

In another embodiment, the invention provides, a wafer polishing and broken platen belt sensing apparatus comprising; a polishing platen adapted to rotate a polishing pad, a motor adapted to rotate the polishing platen via a platen belt, an encoder connected to the motor and adapted to output a first square wave signal in accordance with rotational speed of the motor, a current generating unit adapted to generate a motor driving current in accordance with the first square wave signal, a photo sensor adapted to output a second square wave signal in accordance with the rotational speed of the platen belt, and a controller adapted to receive the motor driving current and the second square wave signal, to determine whether the polishing platen and the motor are rotating normally, and to generate an interlock signal when the polishing platen is not rotating normally.

BRIEF DESCRIPTION OF THE DRAWINGS

Exemplary embodiments of the invention will be described with reference to the accompanying drawings, in which like reference symbols refer to like or similar elements. In the drawings.

DESCRIPTION OF THE EXEMPLARY EMBODIMENTS

Several embodiments of the invention will now be described. Certain well known aspects of conventional polishing systems have been omitted from this description for the sake of brevity. Throughout the description, terms such as "first" and "second" are used to make relative distinctions between exemplary elements and signals, for example, in order to provide clarity in the description. These terms should not be construed as defining a sequence or finite enumeration that limit the scope of the invention.

Figure 1:
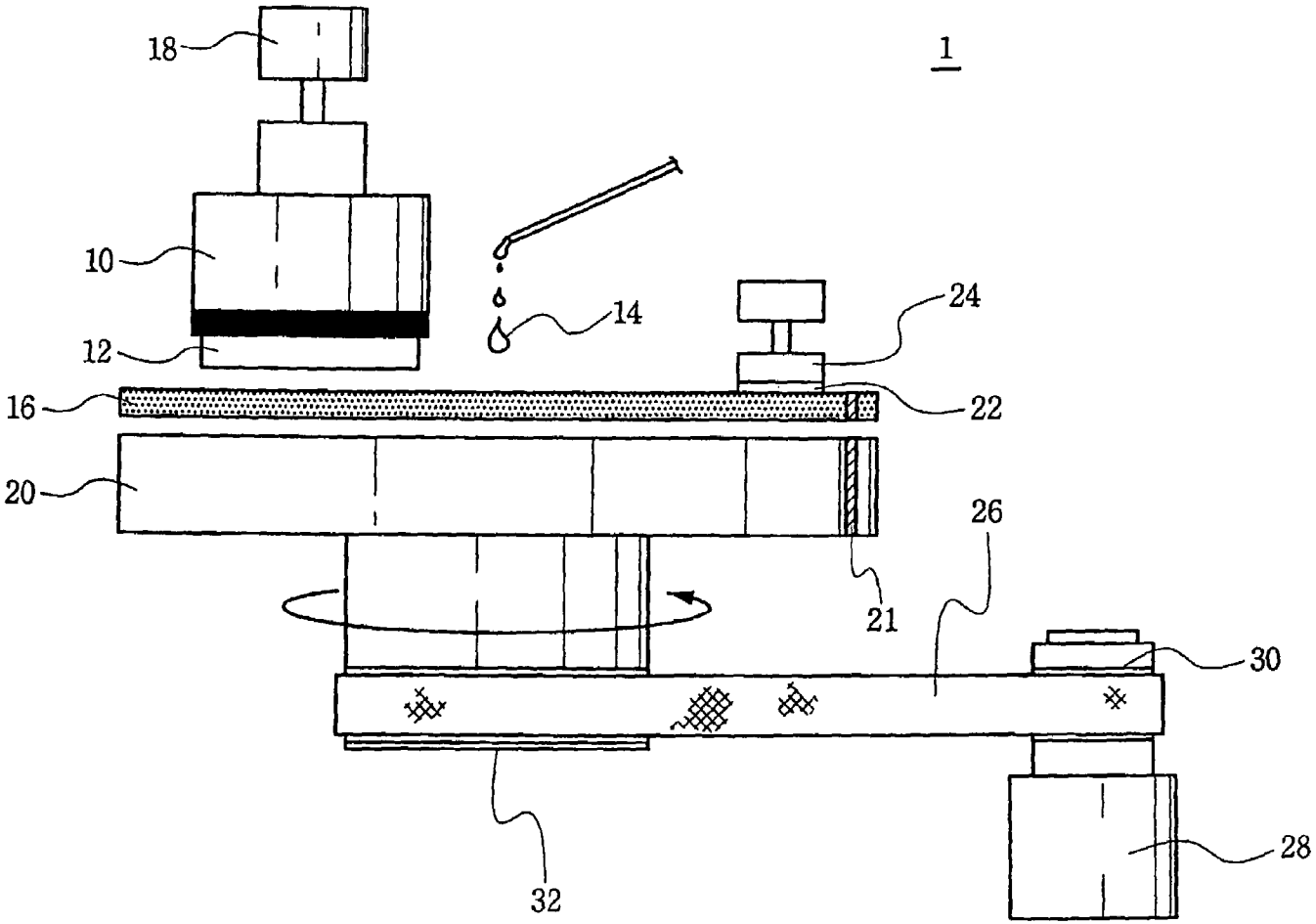
FIG. 1 is a side view of a wafer polishing apparatus in accordance with an exemplary embodiment of the invention.

FIG. 1 is a side view of a wafer polishing apparatus well adapted to the benefits of the present invention.

Referring to FIG. 1, a wafer polishing apparatus 1 comprises a polishing head 10 adapted to hold a wafer 12. Wafer 12 may take one of many forms, such as a semiconductor wafer adapted to the formation of semiconductor devices. Wafer 12 may be held to polishing head 10 by vacuum pressure.

Wafer polishing apparatus 1 further comprises a first motor 18 adapted to rotate polishing head 10, and a polishing platen 20 adapted to hold (i.e., fix) and rotate a polishing pad 16. Polishing platen 20 comprises a hole 21 formed in an outer edge portion of polishing platen 20. In the illustrated example, polishing pad 16 is disposed below polishing head 10. In addition, a pad conditioner head 24 holding a conditioner pad 22 may be used in wafer polishing apparatus 1 to maintain the working surface of polishing pad 16.

A second motor 28 adapted to rotate polishing platen 20 is axially connected to a first drive pulley 30. Rotation of first drive pulley 30 by second motor 28 causes a platen belt 26 to rotate a second drive pulley 32 disposed below polishing platen 20.

As used herein, the term "rotate" means direct rotation of one element by another or indirect rotation of one element by another through one or more intervening elements. The term "driving axis" of the motor means the axis around which the motor causes an element that is directly connected to the motor to rotate. The term "rotational axis" of an element means the axis around which the element rotates. The term "connected" means directly connected or indirectly connected through one or more intervening electrical and/or mechanical elements.

Figure 2:
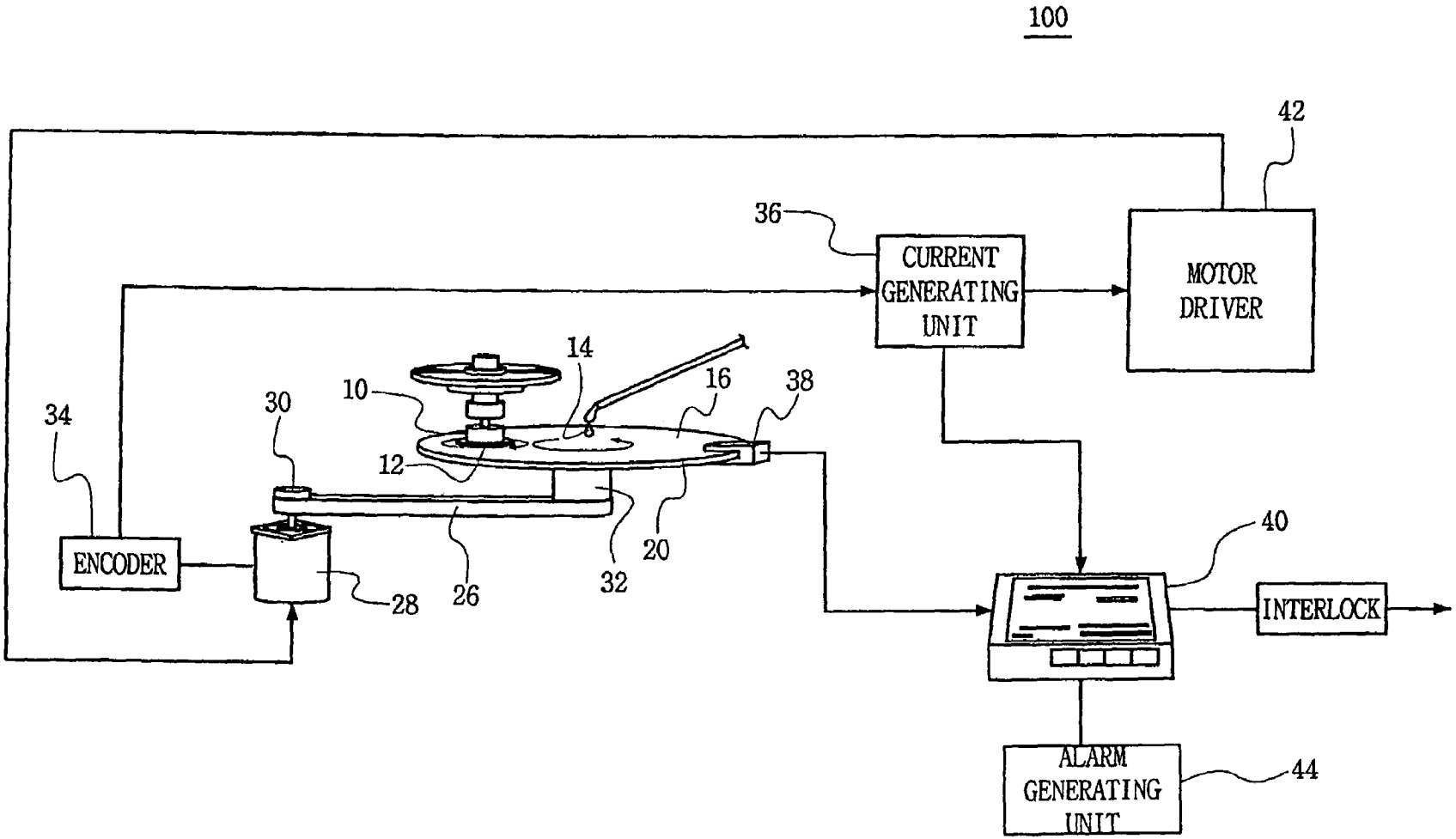
FIG. 2 is a schematic view of a wafer polishing and broken platen belt sensing apparatus in accordance with an exemplary embodiment of the invention.

FIG. 2 is a schematic view of a wafer polishing and broken platen belt sensing apparatus in accordance with one embodiment of the invention. Wafer polishing and broken platen belt sensing apparatus 100 of FIG. 2 comprises a platen belt 26 and is adapted to sense when platen belt 26 becomes broken.

Referring to FIG. 2, wafer polishing and broken platen belt sensing apparatus 100 comprises polishing head 10, wafer 12, polishing pad 16, polishing platen 20, second motor 28, first drive pulley 30, second drive pulley 32, and platen belt 26 as described with reference to FIG. 1. Wafer polishing and broken platen belt sensing apparatus 100 further comprises an encoder 34 connected to second motor 28 and adapted to output a first signal indicating, for example, the rotational speed of second motor 28. A current generating unit 36 is connected to encoder 34 and is adapted to generate a motor driving current in response to the first signal output by encoder 34. A motor drive 42 controls and drives second motor 28 at a desired speed in accordance with the motor driving current received from current generating unit 36.

A photo sensor 38 is disposed at one edge of polishing platen 20 and is adapted to output a second signal indicating the rotational speed of polishing platen 20. A controller 40 is connected to photo sensor 38 and current generating unit 36 and is adapted to generate an interlock signal upon determining that motor 28 and polishing platen 20 are not both rotating normally. That is, controller 40 determines whether motor 28 and polishing platen 20 are rotating normally in accordance with the motor driving current received from current generating unit 36 and the second signal received from photo sensor 38, respectively.

Figure 3:
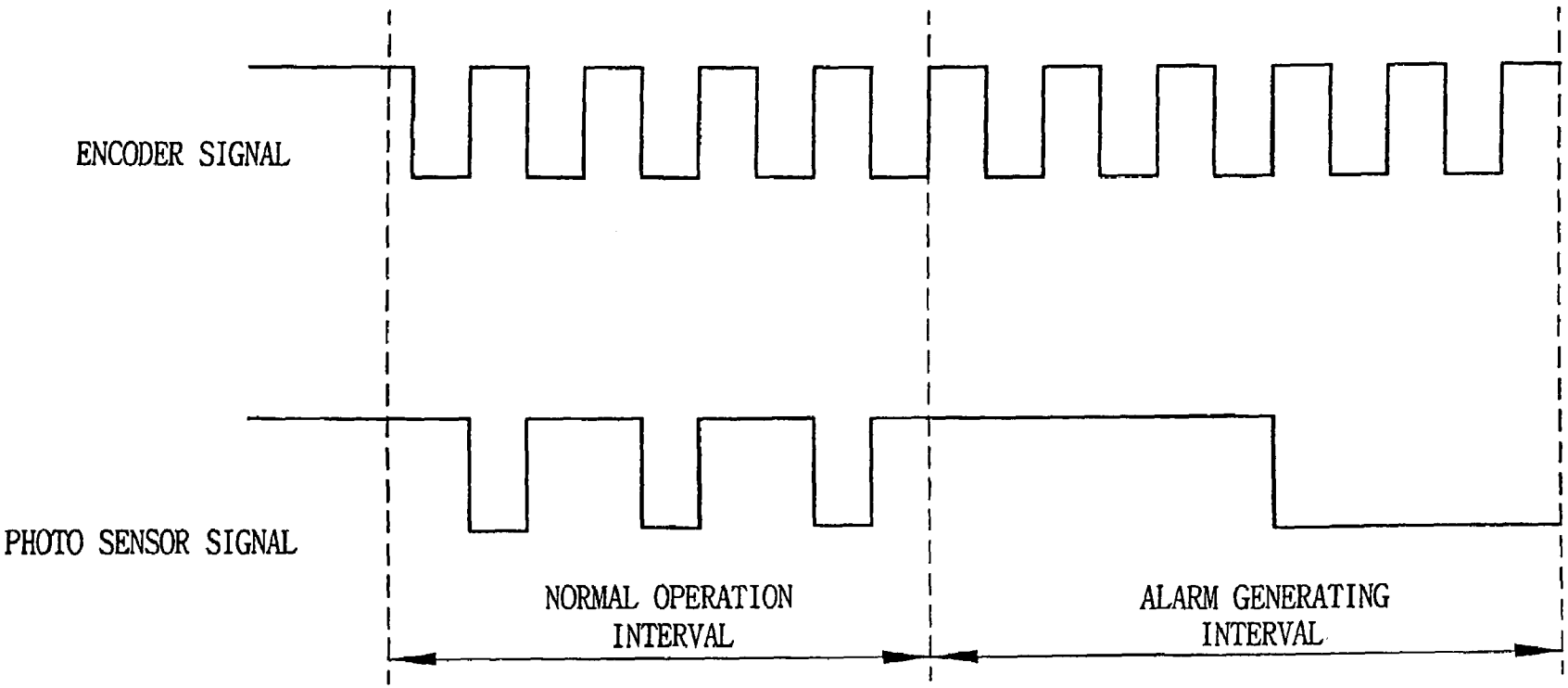
FIG. 3 is a graph showing outputs of an encoder and a photo sensor of FIG. 2 as waveforms.

FIG. 3 is a graph showing respective, exemplary outputs for encoder 34 and photo sensor 36 of FIG. 2. In the illustrated example, square waveforms are assumed.

Figure 4:
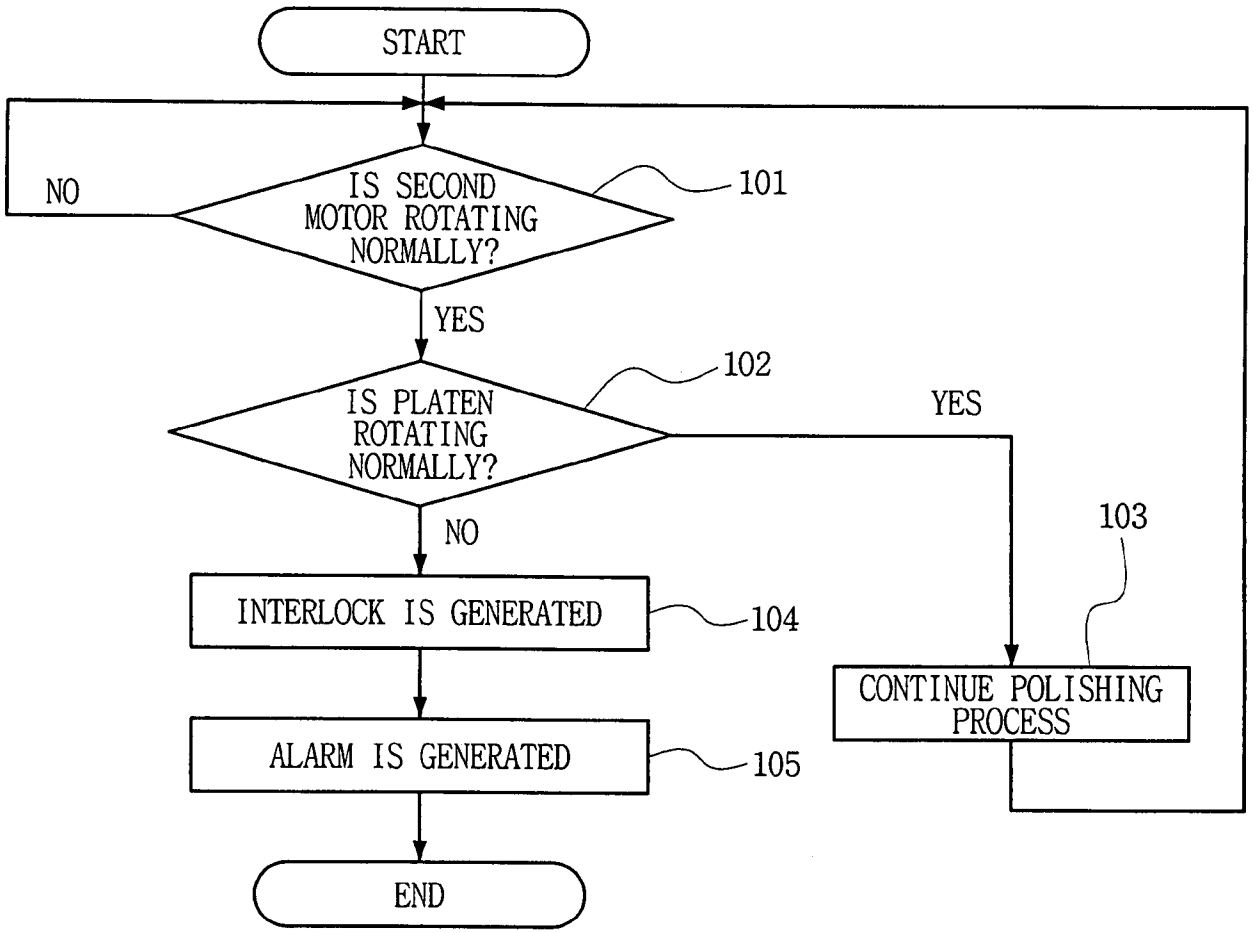
FIG. 4 is a flow chart illustrating a decision process by which a controller of FIG. 2 determines whether to generate an interlock signal in accordance with an exemplary embodiment of the invention.

FIG. 4 is a flow chart illustrating an exemplary control process by which controller 40 determines whether or not to generate an interlock signal in accordance with one embodiment of the invention. A polishing process and a sensing operation of wafer polishing and broken platen belt sensing apparatus 100, in accordance with an exemplary embodiment of the invention, will now be described in more detail with reference to FIGS. 1 through 4.

Referring to FIGS. 1 and 2, wafer 12 is held by polishing head 10, as described previously, and is then rotated, for example, clockwise, as first motor 18, connected to an upper portion of polishing head 10, is driven. Then, when second motor 28 is driven, first drive pulley 30, disposed around the driving axis of second motor 28, rotates. When first drive pulley 30 rotates, platen belt 26 rotates around both first drive pulley 30 and second drive pulley 32, to thereby rotate second drive pulley 32. That is, the rotational force of first drive pulley 30 is transferred from first drive pulley 30 to second drive pulley 32 through platen belt 26. As second drive pulley 32 rotates, polishing platen 20 rotates, for example, counterclockwise. Thus, while wafer 12 is polished, wafer 12 and polishing platen 20, on which polishing pad 16 is disposed, rotate in opposite directions. Also while wafer 12 is polished, polishing head 10 moves downward such that a lower side of wafer 12 is forced into contact with polishing pad 16. A slurry 14 is introduced to an upper surface of polishing pad 16.

As wafer 12 is polished, encoder 34 connected to second motor 28 generates a first square wave signal having a defined cycle for each rotation of second motor 28. The first square wave signal generated by encoder 34 may be similar to the exemplary encoder signal shown in FIG. 3. In addition, photo sensor 38, formed for example from the combination of a light-emitting sensor and a light-receiving sensor, is placed in proximity to hole 21 formed in the outer edge portion of polishing platen 20. The light emitted from the light-emitting sensor is received by the light-receiving sensor through hole 21 once during each rotation of polishing platen 20. Thus, each time polishing platen 20 completes a rotation, photo sensor 38 outputs a second square wave signal having a defined cycle, wherein the defined cycle of the second square signal may be similar to that of the exemplary signal shown in FIG. 3.

Current generating unit 36 receives the first square wave signal from encoder 34, converts it into a motor driving current, and provides the converted motor driving current (or some corresponding indication of the same) to controller 40. So long as current generating unit 36 provides a "normal" (e.g., falling within defined parameters) motor driving current, and so long as photo sensor 38 provides a "normal" second square wave signal, controller 40 will determine that polishing platen 20 is rotating normally. So long as polishing platen 20 is rotating normally, controller 40 allows the polishing process to continue.

However, when controller 40 receives, for example, an abnormal second square wave signal from photo sensor 38, controller 40 causes alarm generating unit 44 to issue an alarm and stops the polishing process with an interlock signal. FIG. 3 illustrates a first time interval of normal operation followed by a second time interval of abnormal operation that will generate an alarm. As can be seen from this arrangement, the abnormal second square wave signal is indicative of a broken platen belt. Within this context, an exemplary operation of controller 40 will now be described with reference to FIGS. 2 and 4.

Referring to FIGS. 2 and 4, controller 40 determines, in accordance with the motor driving current received from current generating unit 36, whether second motor 28 is rotating normally (101). If second motor 28 is rotating normally, controller 40 determines, in accordance with the second square wave signal received from photo sensor 38, whether polishing platen 20 is rotating normally (102). If polishing platen 20 is rotating normally, controller 40 continues the polishing process (103). However, if polishing platen 20 is not rotating normally, controller 40 generates an interlock signal to stop the polishing process (104). After controller 40 generates an interlock signal, controller 40 causes alarm generating unit 44 to generate an alarm (105) to alert a technician that polishing platen 20 is not rotating normally.

Figure 5:
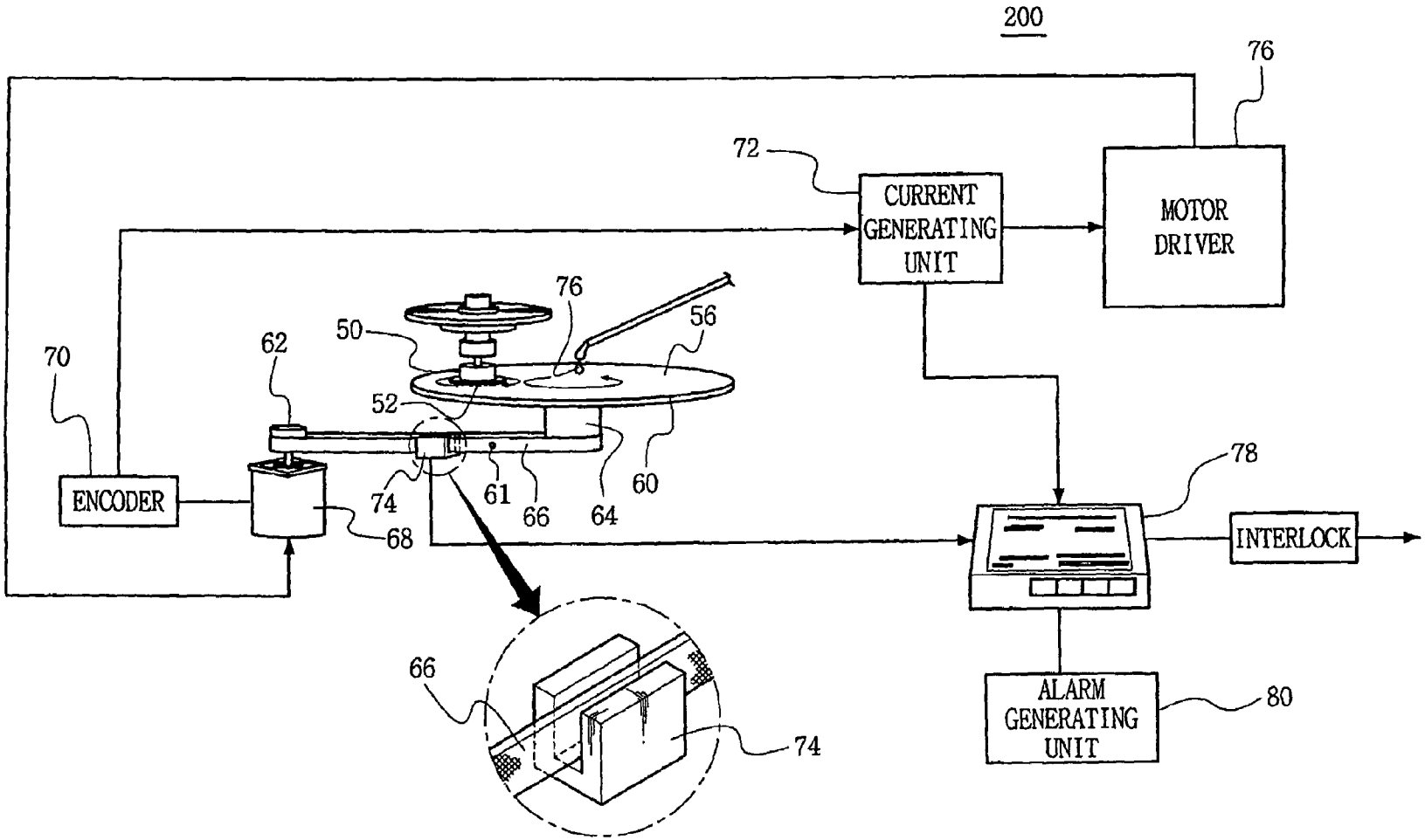
FIG. 5 is a schematic view of a wafer polishing and broken platen belt sensing apparatus in accordance with another exemplary embodiment of the invention.

FIG. 5 is a schematic view of a wafer polishing and broken platen belt sensing apparatus in accordance with another exemplary embodiment of the invention. Wafer polishing and broken platen belt sensing apparatus 200 of FIG. 5 comprises a platen belt 66 and is adapted to sense when platen belt 66 becomes broken.

Referring to FIG. 5, wafer polishing and broken platen belt sensing apparatus 200 comprises a polishing head 50 adapted to hold a wafer 52 using vacuum pressure, a polishing pad 56 disposed below polishing head 50 and adapted to polish wafer 52, a polishing platen 60 adapted to hold (i.e., fix) and rotate polishing pad 56, a motor 68 adapted to rotate polishing platen 60, a first drive pulley 62 disposed around a driving axis of motor 68, a second drive pulley 64 disposed below polishing platen 60 and around a rotational axis of polishing platen 60, and a platen belt 66 disposed around first drive pulley 62 and second drive pulley 64.

Wafer polishing and broken platen belt sensing apparatus 200 further comprises an encoder 70 connected to motor 68 and adapted to output a first square wave signal in accordance with the revolutions of motor 68, a current generating unit 72 adapted to generate a motor driving current corresponding to the first square signal received from encoder 70, and a motor drive 76 adapted to control and drive motor 68 at a selected rate of revolution in accordance with the motor driving current received from current generating unit 72.

Wafer polishing and broken platen belt sensing apparatus 200 still further comprises a photo sensor 74, and a controller 78. Photo sensor 74 is disposed partially around platen belt 66 such that platen belt 66 passes through photo sensor 74 as platen belt 66 rotates, and photo sensor 74 is adapted to output a second square wave signal in accordance with the rotation of platen belt 66. In addition, controller 78 is adapted to generate an interlock signal after determining that motor 68 and platen belt 66 are not both rotating normally in accordance with the motor driving current received from current generating unit 72 and the second square signal received from photo sensor 74.

Figure 6:
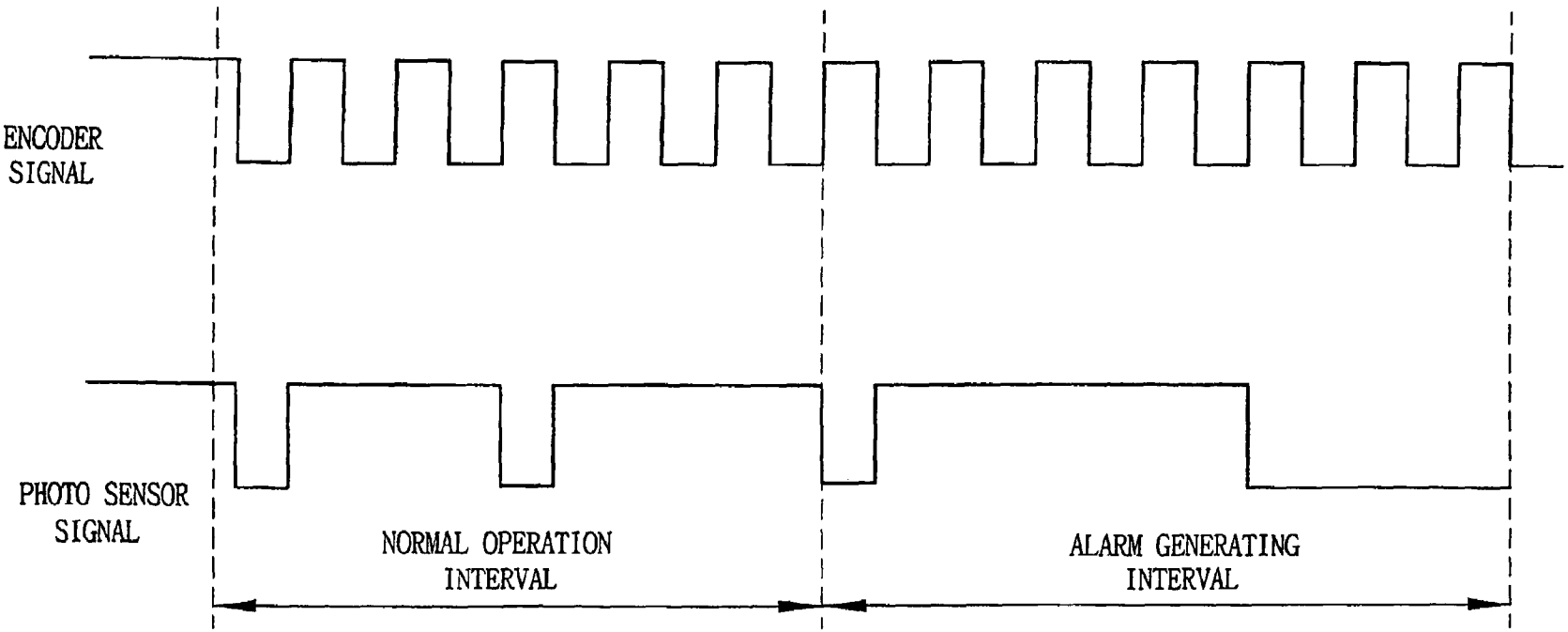
FIG. 6 is a graph showing outputs of an encoder and a photo sensor of FIG. 5 as waveforms.
Figure 7:
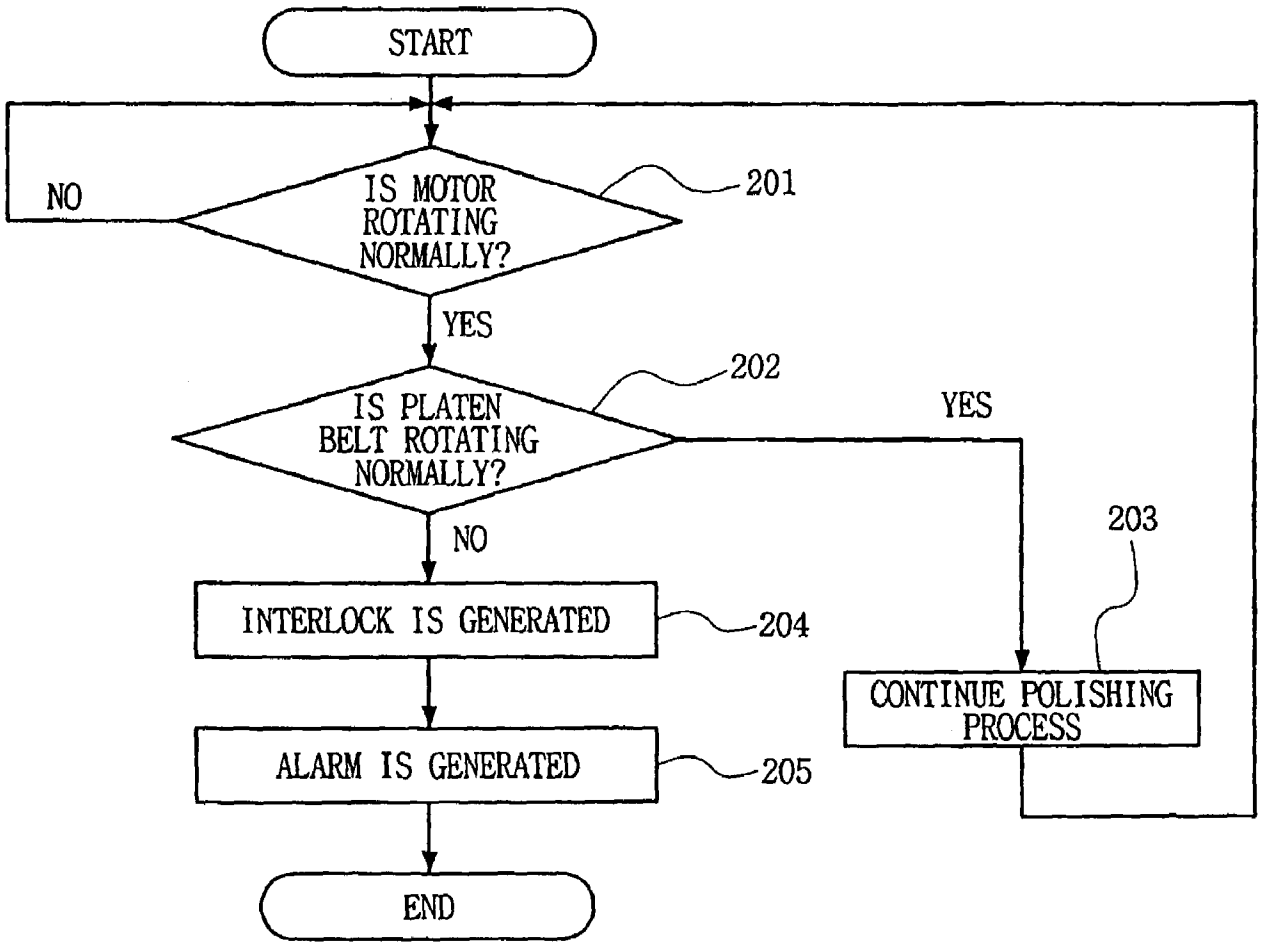
FIG. 7 is a flow chart illustrating a decision process by which a controller determines whether to generate an interlock signal in accordance with another exemplary embodiment of the invention.

FIG. 6 is a graph showing exemplary outputs for encoder 70 and photo sensor 74 of FIG. 5. FIG. 7 is a flow chart illustrating an exemplary control process by which controller 78 determines whether or not to generate an interlock signal in accordance with another exemplary embodiment of the invention. A polishing process and a sensing operation of wafer polishing and broken platen belt sensing apparatus 200 of FIG. 5, in accordance with an exemplary embodiment of the invention, will now be described in more detail with reference to FIGS. 5 through 7.

Referring to FIG. 5, wafer 52 is held by polishing head 50, as described previously, and is then rotated, for example, clockwise, as polishing head 50 is rotated. Then, when motor 68 is driven, first drive pulley 62 disposed around the driving axis of motor 28 rotates. When first drive pulley 62 rotates, platen belt 66 rotates around both first drive pulley 62 and second drive pulley 64, and rotates driven pulley 64. That is, the rotational power of first drive pulley 62 is transferred from drive pulley 62 to drive pulley 64 through platen belt 66, thus rotating driven pulley 64. As second drive pulley 64 rotates, polishing platen 60 rotates, for example, counterclockwise. Thus, while wafer 52 is polished, wafer 52 and polishing platen 60, on which polishing pad 56 is disposed, rotate in opposite directions. Also while wafer 52 is polished, polishing head 50 is moved downward such that a lower side of wafer 52 is forced into contact with polishing pad 56, which rotates in the direction opposite of the direction in which wafer 52 rotates. A slurry 76 is introduced to an upper surface of polishing pad 56.

As wafer 52 is polished, encoder 70 connected to motor 68 generates the first square wave signal having a defined cycle corresponding to the rotational speed of motor 68. The first square wave signal generated by encoder 70 may be similar to the exemplary encoder signal shown in FIG. 6.

Photo sensor 74 may comprise a light-emitting sensor and a light-receiving sensor. The light-emitting sensor and the light-receiving sensor are disposed on opposite sides of platen belt 66, and a hole 61 is formed in a middle portion of platen belt 66. In photo sensor 74, the light emitted from the light-emitting sensor is received by the light-receiving sensor through hole 61 formed in platen belt 66 once every rotation of polishing platen 66. Thus, each time platen belt 66 makes a normal rotation, photo sensor 74 outputs the second square signal with the defined cycle. In one embodiment, the second square wave signal may be similar to that shown in FIG. 6. Current generating unit 72 receives the first square wave signal from encoder 70, converts it into a motor driver current, and provides the converted motor drive current to controller 78. When current generating unit 72 provides a normal motor driving current value to controller 78, and photo sensor 74 provides a normal second square wave signal to controller 78, controller 78 determines that platen belt 66 is not broken. When controller 78 determines that platen belt 66 is not broken, controller 78 allows the polishing process to continue.

However, when current generating unit 72 provides controller 78 with a normal motor driving current value, but photo sensor 74 does not generate a normal second square wave signal, controller 78 determines that platen belt 66 is broken. When controller 78 determines that platen belt 66 is broken, controller 78 generates an interlock signal to stop the polishing process and also causes an alarm generating unit 80 to generate an alarm.

When platen belt 66 does not rotate normally while motor 68 is rotating normally, controller 78 generates an interlock signal and an alarm. This operation of controller 78 will now be described with reference to FIGS. 5 and 7.

Referring to FIGS. 5 and 7, controller 78 determines, in response to the motor driving current received from current generating unit 72, whether motor 68 is rotating normally (201). If motor 68 is rotating normally, controller 78 determines, in accordance with the second square wave signal received from photo sensor 74, whether platen belt 66 is rotating normally (202). If platen belt 66 is rotating normally, controller 78 allows wafer polishing and broken platen belt sensing apparatus 200 to continue the polishing process (203). However, if platen belt 66 is not rotating normally, controller 78 generates an interlock signal to stop the polishing process (204). Next, controller 78 causes alarm generating unit 80 to generate an alarm (205) to alert a technician that platen belt 66 is not rotating normally.

Embodiments of the invention are adapted to use a photo sensor to sense abnormalities in the rotation of a polishing platen or a platen belt, and to thereby sense whether the platen belt is broken. However, it is also possible to detect whether the platen belt is broken by monitoring the movement of the polishing platen or the platen belt. Accordingly, generating an interlock signal upon determining, in accordance with the movement of the polishing platen or the platen belt, that a platen belt is broken is within the scope of the invention.

In addition, by generating an interlock signal to stop a wafer polishing process after detecting that a platen belt is broken, embodiments of the invention have the advantage of being able to prevent wafer loss that may occur during a wafer polishing process if the process were not stopped after the platen belt has broken.

The invention has been described with reference to exemplary embodiments. However, it will be understood that the scope of the invention is not limited to the disclosed embodiments. Rather, the scope of the invention includes various modifications and alternative arrangements within the capabilities of persons skilled in the art. The scope of the claims, therefore, should be accorded the broadest interpretation so as to encompass all such modifications and similar arrangements.

What is claimed is:

1. A wafer polishing and broken platen belt sensing apparatus comprising:

a polishing platen adapted to rotate a polishing pad;

a motor adapted to rotate the polishing platen;

a first drive pulley disposed around a driving axis of the motor;

a second drive pulley disposed below the polishing platen and around a rotational axis of the polishing platen;

a platen belt connecting the first drive pulley and the second drive pulley;

an encoder connected to the motor and adapted to output a first square wave signal in accordance with rotational speed of the motor;

a current generating unit adapted to generate a motor driving current in accordance with the first square wave signal;

a photo sensor adapted to output a second square wave signal in accordance with the rotational speed of the polishing platen; and, a controller adapted to receive the motor driving current and the second square wave signal, to determine whether the polishing platen and the motor are rotating normally, and to generate an interlock signal when the polishing platen is not rotating normally.

2. The apparatus of claim 1, wherein the polishing platen comprises a hole formed in an outer edge portion of the polishing platen.

3. The apparatus of claim 2, wherein the photo sensor comprises a light-emitting sensor and a light-receiving sensor.

4. The apparatus of claim 3, wherein the light-emitting sensor and the light-receiving sensor are disposed on opposite sides of the polishing platen proximate the outer edge.

5. The apparatus of claim 1, further comprising an alarm generating unit connected to the controller and adapted to generate an alarm when the polishing platen and the motor are not rotating normally.

6. The apparatus of claim 5, wherein the platen belt comprises a hole formed in a middle portion of the platen belt.

7. The apparatus of claim 6, wherein the photo sensor comprises a light-emitting sensor and a light-receiving sensor.

8. The apparatus of claim 7, wherein the light-emitting sensor and the light-receiving sensor are disposed on opposite sides of the platen belt.

9. The apparatus of claim 1, further comprising a motor drive connected to the current generating unit and controlling the rotational speed of the motor in response to the motor driving current.

10. A wafer polishing and broken platen belt sensing apparatus comprising:

a polishing platen adapted to rotate a polishing pad;

a motor adapted to rotate the polishing platen via a platen belt;

an encoder connected to the motor and adapted to output a first square wave signal in accordance with rotational speed of the motor;

a current generating unit adapted to generate a motor driving current in accordance with the first square wave signal;

a photo sensor adapted to output a second square wave signal in accordance with the rotational speed of the platen belt; and, a controller adapted to receive the motor driving current and the second square wave signal, to determine whether the polishing platen and the motor are rotating normally, and to generate an interlock signal when the polishing platen is not rotating normally.

11. The apparatus of claim 10, wherein the polishing platen comprises a hole formed in an outer edge portion of the polishing platen.

12. The apparatus of claim 11, wherein the photo sensor comprises a light-emitting sensor and a light-receiving sensor.

13. The apparatus of claim 12, wherein the light-emitting sensor and the light-receiving sensor are disposed on opposite sides of the polishing platen proximate the outer edge.

14. The apparatus of claim 10, further comprising an alarm generating unit connected to the controller and adapted to generate an alarm when the polishing platen and the motor are not rotating normally.

15. The apparatus of claim 10, wherein the platen belt comprises a hole formed in a middle portion of the platen belt.

16. The apparatus of claim 15, wherein the photo sensor comprises a light-emitting sensor and a light-receiving sensor.

17. The apparatus of claim 16, wherein the light-emitting sensor and the light-receiving sensor are disposed on opposite sides of the platen belt.

18. The apparatus of claim 10, further comprising a motor drive connected to the current generating unit and controlling the rotational speed of the motor in response to the motor driving current.

* * * * *